US007621097B2

(12) United States Patent
Wilhour

(10) Patent No.: US 7,621,097 B2
(45) Date of Patent: Nov. 24, 2009

(54) SYSTEM AND METHOD FOR CASTING COLUMN BASES FOR A POST FRAME STRUCTURE

(76) Inventor: Weston Wilhour, R.R. 3 Box 125, Altamont, IL (US) 62411

( * ) Notice: Subject to any disclaimer, the term of this patent is extended or adjusted under 35 U.S.C. 154(b) by 91 days.

(21) Appl. No.: 11/557,133

(22) Filed: Nov. 7, 2006

(65) Prior Publication Data

US 2008/0104924 A1 May 8, 2008

(51) Int. Cl.
*E04G 21/10* (2006.01)
*E04G 17/00* (2006.01)
*E04G 13/02* (2006.01)

(52) U.S. Cl. ..... 52/741.15; 249/48; 249/51; 249/207

(58) Field of Classification Search ..... 249/34, 249/31, 32, 35, 8, 1, 48, 51, 207; 52/741.15, 52/741.14, 745.17, 745.18, 749.13; 264/31; 405/229, 231; 33/624, 645
See application file for complete search history.

(56) References Cited

U.S. PATENT DOCUMENTS 723,064 A 3/1903 Stoner
822,814 A 6/1906 Baker
986,957 A 3/1911 Wallin
2,448,883 A 9/1948 Hall
3,632,078 A 1/1972 Dashew
3,847,339 A * 11/1974 Farrell ..... 249/1
4,125,973 A * 11/1978 Lendrihas ..... 249/188
4,441,685 A * 4/1984 Greeson ..... 249/51
4,629,155 A 12/1986 Dula
4,767,241 A 8/1988 Wells
4,918,891 A 4/1990 Gerszewski
4,993,878 A * 2/1991 Beamer ..... 249/10
5,271,203 A 12/1993 Nagle
5,475,950 A 12/1995 Palmer
D394,271 S 5/1998 Croghan
5,785,459 A 7/1998 Swinimer
5,800,727 A 9/1998 Croghan
5,836,124 A 11/1998 Aspehaug et al.
5,890,333 A 4/1999 Boroviak
6,401,411 B1 6/2002 Maglio
6,449,791 B1 9/2002 Vodicka
6,513,291 B2 2/2003 Gilsdorf
6,543,742 B2 4/2003 Wells
6,578,333 B1 6/2003 Gagliano
6,623,212 B1 9/2003 Fonfrede et al.
6,840,491 B2 1/2005 Swinimer
6,899,535 B2 5/2005 Mihelcic et al.
6,964,139 B2 11/2005 Meyer et al.
7,076,925 B2 7/2006 Gagliano
2002/0179811 A1* 12/2002 Janesky ..... 249/189

(Continued)

*Primary Examiner*—Michael Safavi
(74) *Attorney, Agent, or Firm*—Fleit Gibbons Gutman Bongini & Bianco; Paul D. Bianco; Martin Fleit

(57) ABSTRACT

A system and method for building foundational bases for a post frame building. The system includes a plurality of foundational base molds which are positionable in individually dug holes, defining the foot print of the building, where the molds are positioned spaced off the bottom of the holes. The molds can be rigidly tied together to allow for uniform alignment of the individual molds. Upon alignment, concrete is poured into and through the molds. Once sufficiently hardened, the molds are removed, revealing the foundational bases, which include an integrated footer and column base.

18 Claims, 12 Drawing Sheets

U.S. PATENT DOCUMENTS

2004/0111991 A1 6/2004 Swinimer
2005/0072078 A1 4/2005 Calle
2005/0204686 A1 9/2005 Meyer et al.

* cited by examiner

SYSTEM AND METHOD FOR CASTING COLUMN BASES FOR A POST FRAME STRUCTURE

FIELD OF THE INVENTION

The invention relates to a system and method for building a post frame structure, and more specifically, to a system and method for making casted footer and integrated column bases.

BACKGROUND OF THE INVENTION

Post frame structures were introduced as a quick and economical means to acquire square footage under roof. Recently with the rising cost of non-renewable resources such as steel, and improvements in building standards, wood framed structures, specifically those in the post frame industry, saw an opportunity to enter markets not previously targeted to a large extent.

As such, there has been a generally accepted need for longer lasting building designs. Among the concerns in post frame construction is post degradation at or below ground surface. Traditionally, a hole was drilled in the ground and posts were set in the hole, anchored, backfilled, and the building was built on the poles. The base of the post was exposed to the moisture in the ground, being subjected to rot and other forms of degradation. As a result, the life of the building was limited. Furthermore, this affected the resale value of the property and building.

Concrete is the most widely accepted solution to this problem. Post framed versions were then designed to set on a concrete foundation and footing. Though successful with the commercial market, the large expense of the concrete foundation proved too expensive to the general market. Other attempts have been made with moderate success to address the degradation problem and still remain within the economical boundaries of the market. Among them are precast columns and different types of poured in place molds.

SUMMARY OF THE INVENTION

The present invention provides a system for making an integrated footer and column base. The system includes a grade seat placement tool, a grade seat; and a gradable-alignment mold apparatus (GAMA). The grade seat placement tool includes an upper plate; a lower plate; and hollow alignment posts positioned between the upper and lower plates, wherein the top ends of the hollow alignment posts extend through the upper plate and bottom ends of the hollow alignment posts extend through the lower plate.

The GAMA includes a first member and a second member, wherein the first and second members are detachably connected together defining a passage therethrough. A plurality of grade fixtures are affixed to the first and second members.

Grade seats are provided, where the grade seats are slidably positionable through the hollow alignment posts and guides.

In a method of making integrated footer and column bases for a post frame building the perimeter of the post frame building is mapped on the building site. The corners of the building are determined and marked, where the high and low grade wise corners are located.

A plurality of holes are dug around the perimeter of the building, where the holes have a diameter greater than that of the grade seat placement tool. For each of the holes, the grade seat placement tool is positioned therein, where the grade seat placement tool is aligned with the perimeter of the building.

Grade seats are positioned in each of the hollow alignment posts of the grade seat placement tool, where the grade seats are driven into the ground until a top of the grade seats are on grade with each other. The grade seat placement tools are removed from the holes, leaving the grade seats in place. GAMAs are positioned in each of the holes, where the GAMAs are positioned on the grade seats, such that the grade seats are slid into the hollow grade fixtures. The grade seats support the GAMAs of the floor of the hole, such that the top of the GAMA is on the established grade.

Once all of the GAMAs have been installed, the GAMAs are interconnected to each other using alignment straight edges (ASEs). The ASEs are installed on the GAMAs around the perimeter, where the ASEs are connected together forming a single structural unit. In this manner the ASEs can be used to align all of the GAMAs as a single unit.

Once aligned, cement is poured through a central passage in each of the GAMAs and into the hole, until the cement in the passage is level with the top of the GAMA. Once the cement has set, each of the GAMAs is separated in its two halves and removed from the holes. The resulting hardened cement forms a footer with an integrated column base in each of the holes, where the tops of each of the column bases are level.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

The present invention provides a system and method for building foundational bases for a post frame building. The system of the present invention includes a plurality of foundational base molds which are positionable in individually dug holes, defining the foot print of the building. The molds can be rigidly tied together to allow for uniform alignment of the individual molds. Upon alignment, concrete is poured into and through the molds. Once sufficiently hardened, the molds are removed, revealing the foundational bases.

Figure 1:
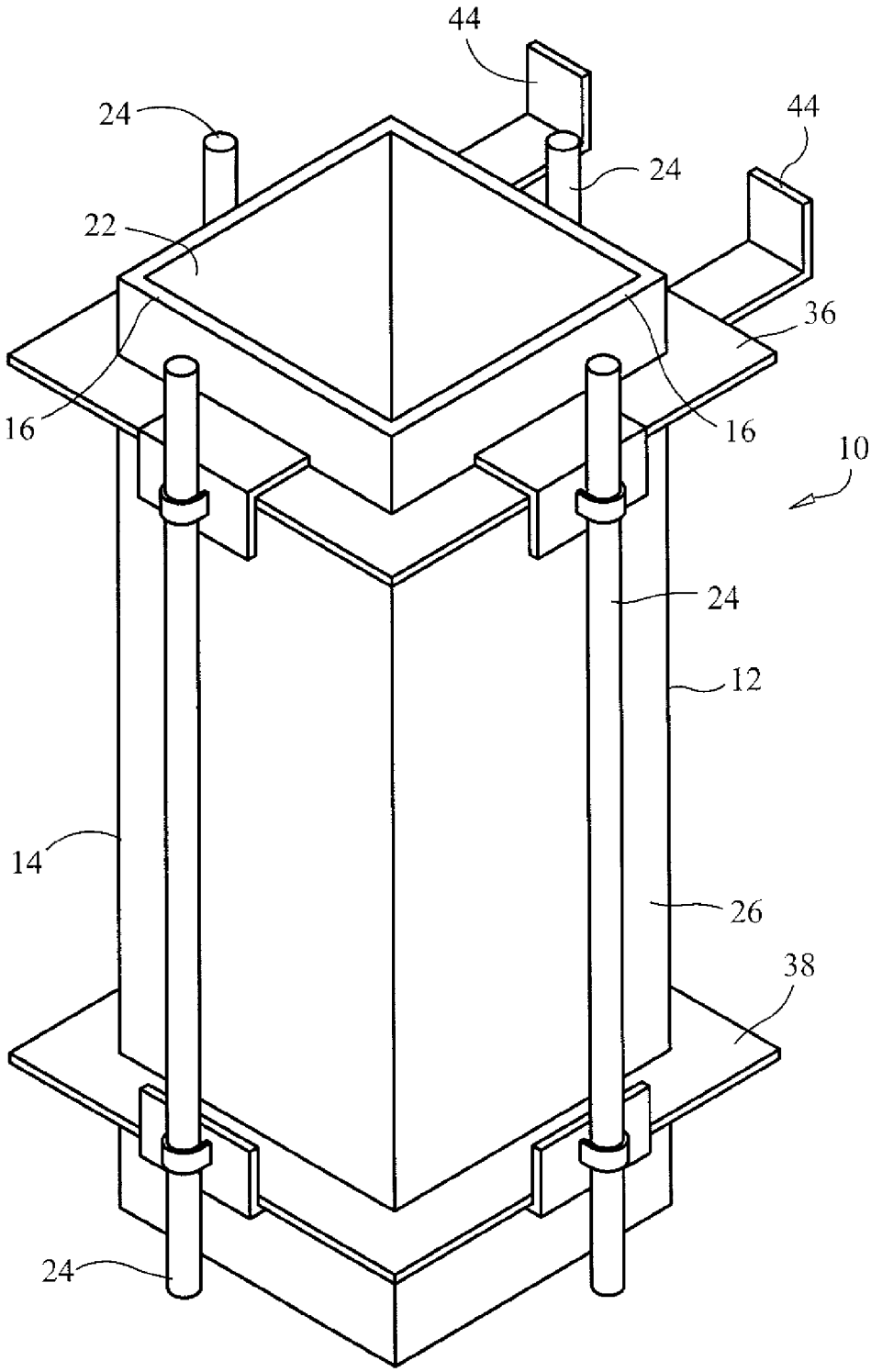
FIG. 1 depicts a perspective view of a gradable-alignment mold apparatus (GAMA) of the present invention.
Figure 2:
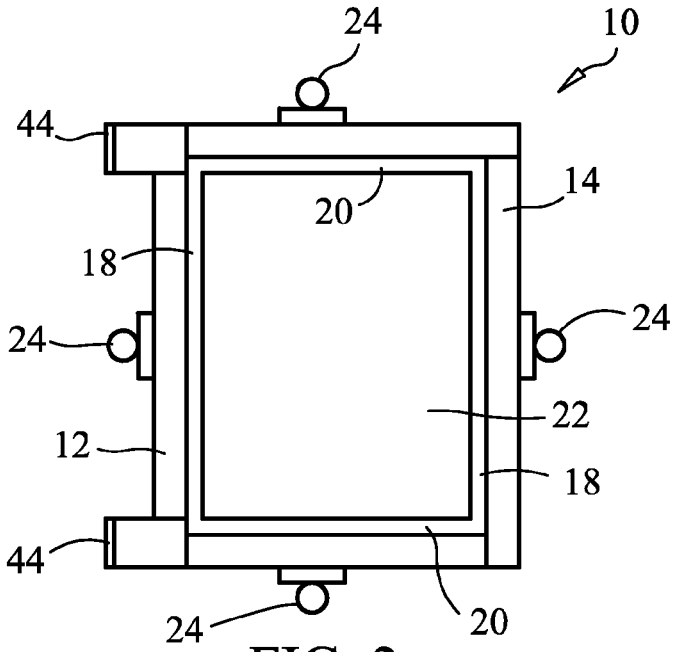
FIG. 2 depicts a top view of the GAMA of FIG. 1.

Referring now to the drawing figures in which like reference designators refer to like elements, there is shown in FIG. 1 a gradable-alignment mold apparatus (GAMA) 10 of the present invention. The GAMA 10 includes first and second members 12 and 14 which are detachably connected together. The first and second members 12 and 14 each include a mold wall 16, defining the shape of the GAMA 10. In an embodiment, as also shown in FIGS. 2 and 3, the mold walls 16 include first and second sections 18 and 20, which are provided in a substantially orthogonal relationship, such that when the first and second members 12 and 14 are affixed together the GAMA 10 has a substantially square shaped cross sectional area 22.

However, it is contemplated that the mold walls 16 can have other configurations, such that the combination of the first and second members 12 and 14 combine to form alternative shaped cross sectional areas 22, such as, rectangular, triangular, circular, elliptical, and the like.

Figure 4:
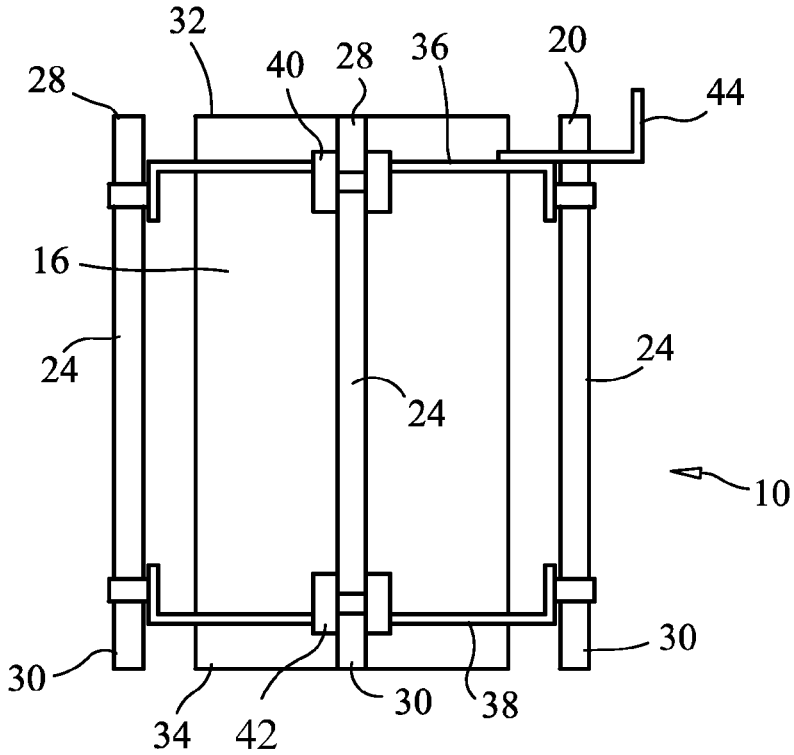
FIG. 4 depicts a side view of the GAMA of FIG. 1.
Figure 3:
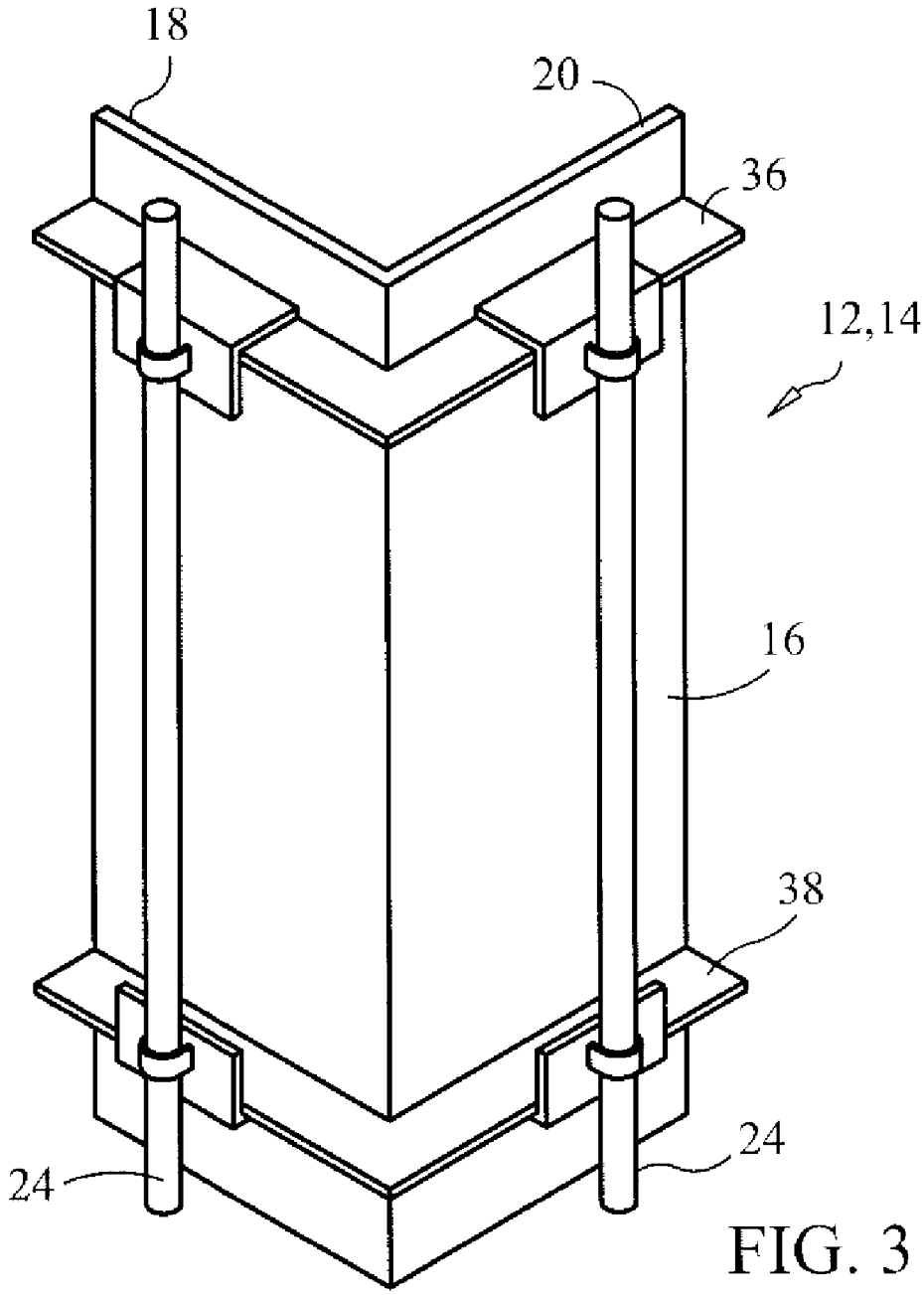
FIG. 3 depict a perspective view of the first or second member of the GAMA of FIG. 1.

Referring also to FIGS. 3 and 4, the first and second members 12 and 14 each include hollow grade fixtures 24 positioned on and about an exterior surface 26 of the walls 16. The grade fixtures 24 are evenly spaced about the exterior surface 26 of the walls 16, where for example, the grade fixtures 24 can be centrally positioned along the longitudinal lengths of each of the first and second sections 18 and 20 of the walls 16.

The top ends 28 of the grade fixtures 24 are positioned substantially planar with the top edge 32 of the walls 16, and the bottom ends 30 of the grade fixtures 24 are position substantially planar with the bottom edge 34 of the walls 16.

In an embodiment, support brackets 36 and 38 are attached to the exterior surface 26 of the walls 16, where the support brackets 36 and 38 provide structural strengthening of the walls 16. The grade fixtures 24 can be affixed to the support brackets 36 and 38 with attachment brackets 40 and 42.

Figure 5:
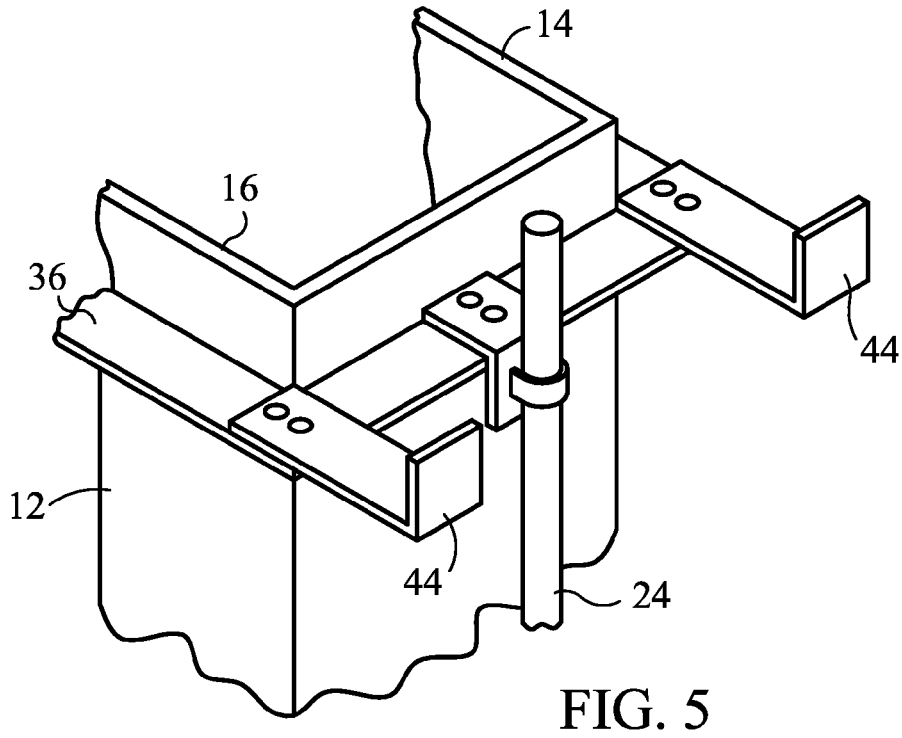
FIG. 5 depicts the alignment channels of the GAMA of FIG. 1.

Referring to FIGS. 1 and 5, alignment channels 44 are connected to the first member 12. The alignment channels 44 are utilized to align the GAMA 10 as discussed in more detail below.

Figure 6:
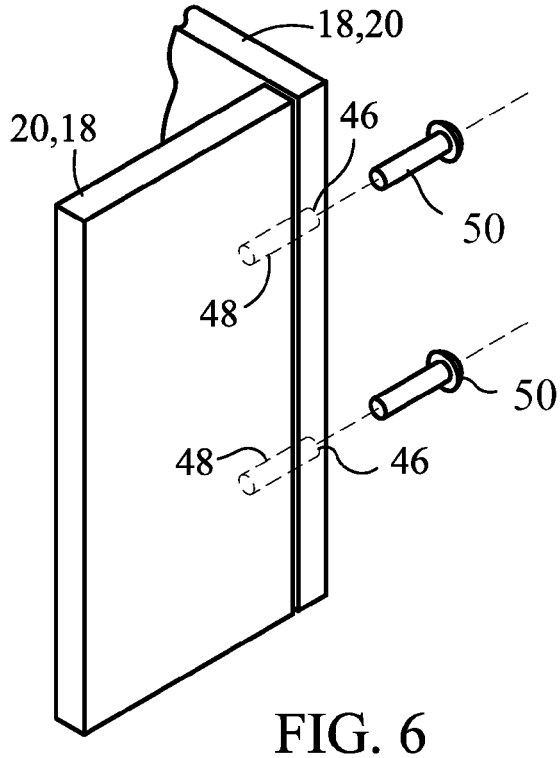
FIG. 6 depicts a connection means of the first and second members of the GAMA of FIG. 1.

As previously discussed, the first and second members 12 and 14 are detachably connected together. The first and second members 12 and 14 can be connected together using belts, clamps, or fasteners, such as screws, bolts, or pins. Referring to FIG. 6, a section 18 or 20 of the wall 16 of the first or second member 12 or 14 includes pin holes 46 there through. An abutting section 20 or 18 of the wall 16 of the second or first member 14 or 12 includes pin channels 48 through the thickness of the wall 16, where the pin holes 46 are aligned with the pin channels 48. Pins 50 are inserted through the pin holes 46 into the pins channels 48, to detachably attach the first and second members 12 and 14.

Figure 7:
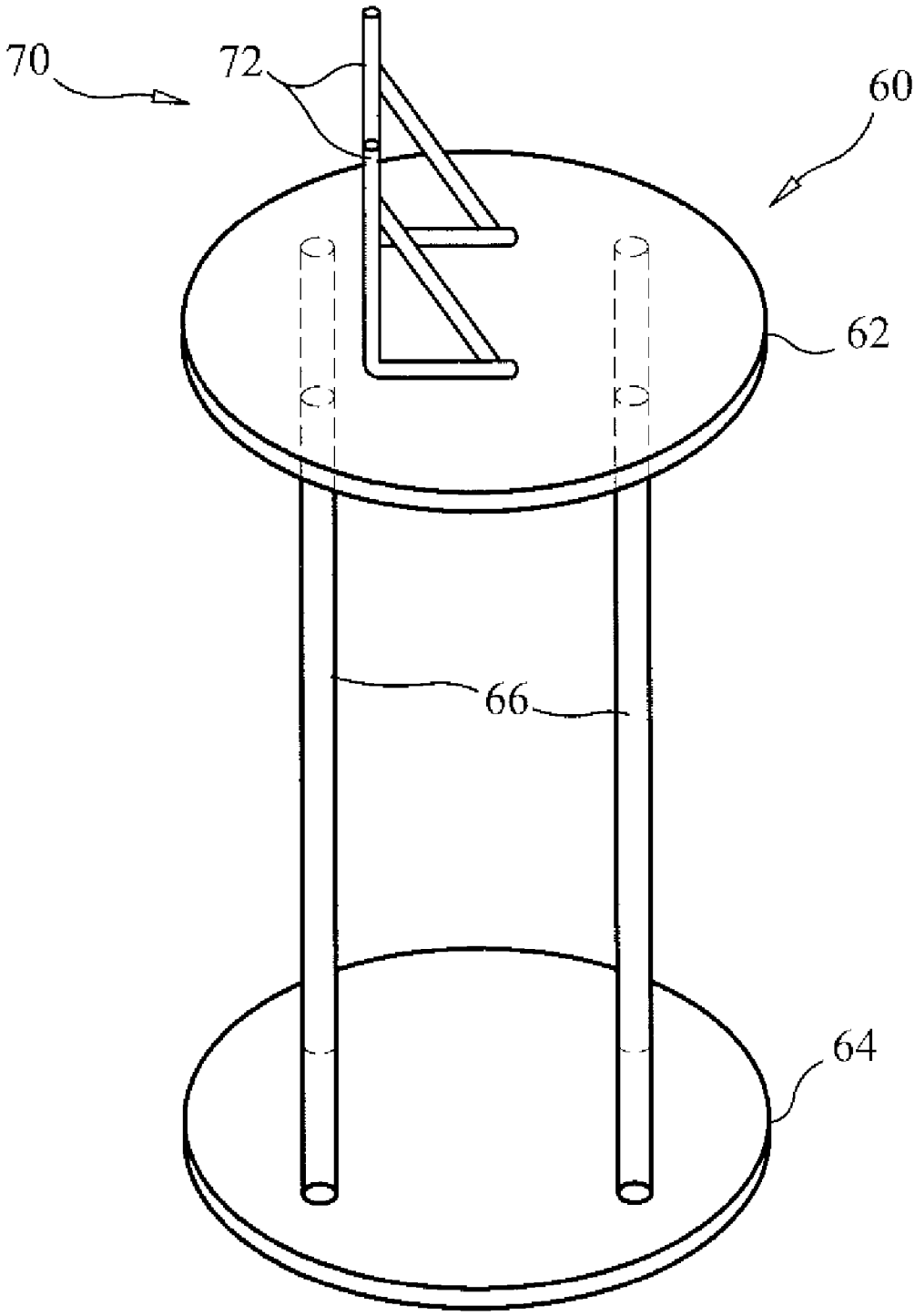
FIG. 7 depicts a perspective view of a grade seat placement tool of the present invention.
Figure 8:
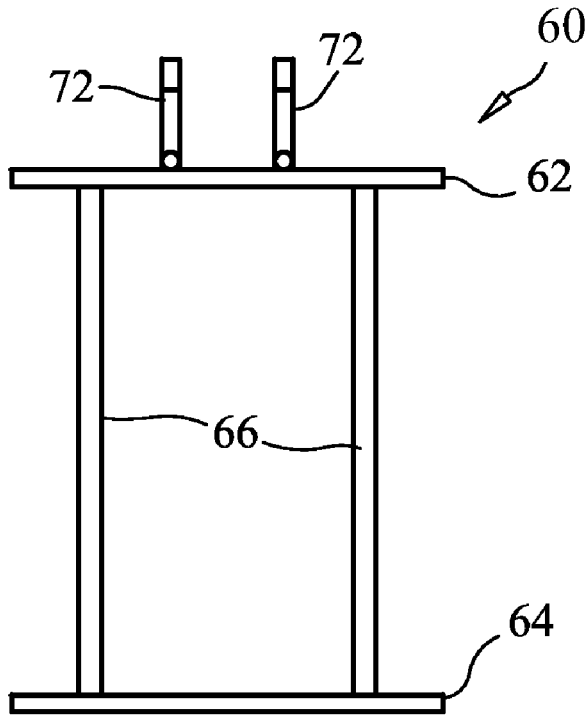
FIG. 8 depicts a side view of the grade seat placement tool of FIG. 7.
Figure 9:
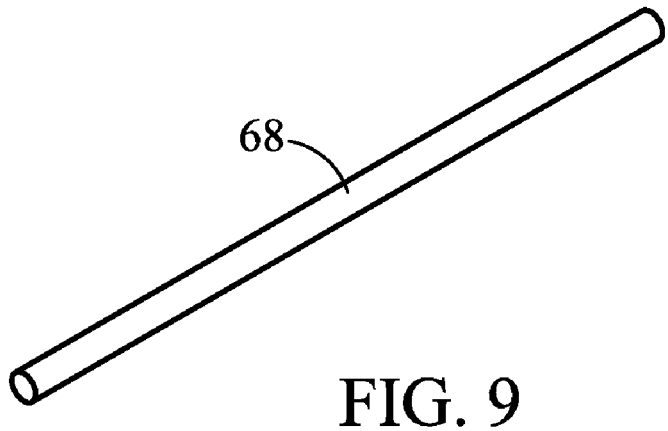
FIG. 9 depicts a grade seat of the present invention.

Referring to FIGS. 7 and 8, a grade seat placement tool 60 of the present invention is provided. The grade seat placement tool 60 includes an upper plate 62 and a lower plate 64. The upper and lower plates 62 and 64 are connected together with hollow alignment posts 66, where the alignment post 66 are arranged to match the positioning of the grade fixtures 24 on the GAMA 10. The alignment posts 66 are positioned through the upper and lower plates 62 and 64, such that grade seats 68 (See FIG. 9) can be positioned through the upper and lower plates 62 and 64, and each of the hollow alignment post 66.

An alignment tool 70 is positioned on the upper plate 62, where the alignment tool 70 can be used to align the grade seat placement tool 60 as described in further detail below. The alignment tool can include a pair of whisker guides 72 centrally positioned on the upper plate 62.

In an exemplary method of use, the building size is determined, squaring the four corners of the building and determining the perimeter of the building. The four corners of the building are marked, and the highest and lowest corners, grade wise, are determined. After which, the center of each hole to be excavated is marked. Each hole will be excavated eg. 8' on center, 10' on center, etc.

The holes are excavated, where an oversized hole is excavated having a diameter greater than that of the grade seat placement tool 60, and to the desired depth. The hole is oversized to: accommodate wiggle room to align the GAMA 10 in or out and side to side in the event the hole is not drilled in the perfect spot; provide enough space to split and remove the GAMA 10 after concrete is set; and provide a subsurface expanded footer wider than the upper column base to resist heaving or any upward force. The bottom of the hole is cleared of loose dirt and packed. A string or straight line is set at the perimeter of the structure according to the previously established parameters.

Figure 10:
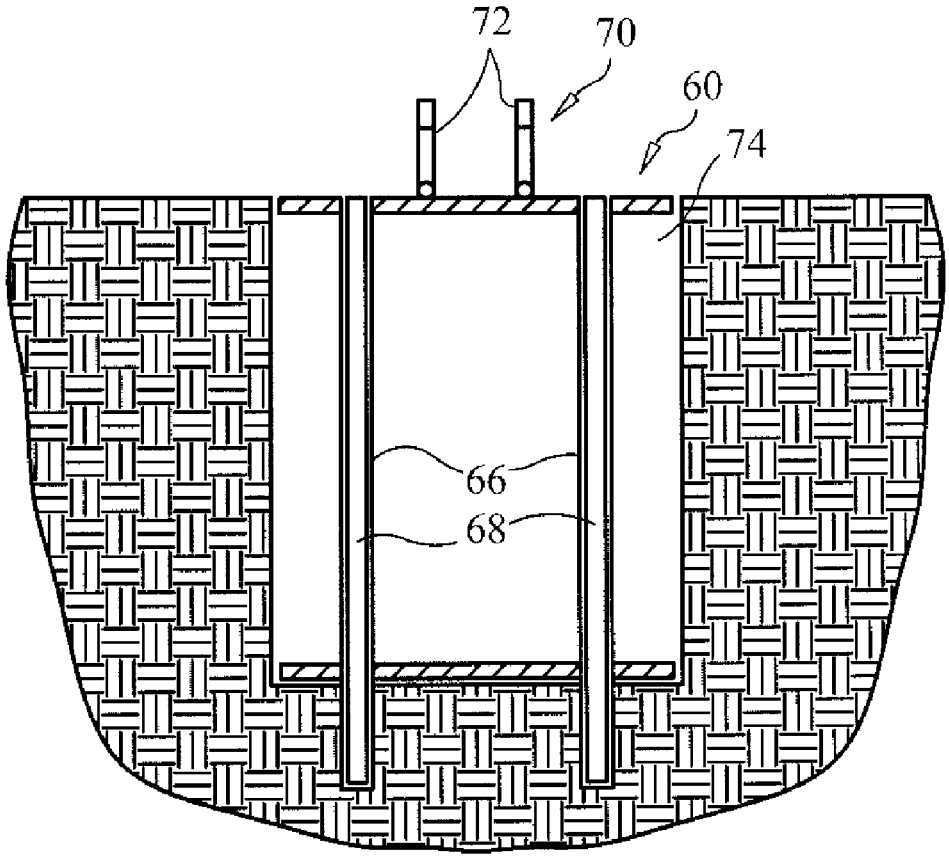
FIG. 10 is a cross sectional view of the installation of the grade seats in a hole.

Referring to FIG. 10, the grade seat placement tool 60 is set in the hole 74, where the alignment tool 70 is aligned with the string. To align the alignment tool 70, the whiskers 72 are aligned with the string, being aligned with the predetermined outside perimeter of the structure. The alignment of the whiskers 72 properly orients the alignment posts 66 within the hole 74.

The grade seats 68 are positioned through the alignment posts 66. As shown in FIG. 7, the grade seat placement tool 60 includes four alignment posts 66, and as such, four grade seats 68 are utilized. The grade seats 68 are driven into the ground, until the top of the grade seats 68 are equal to the grade.

Figure 11:
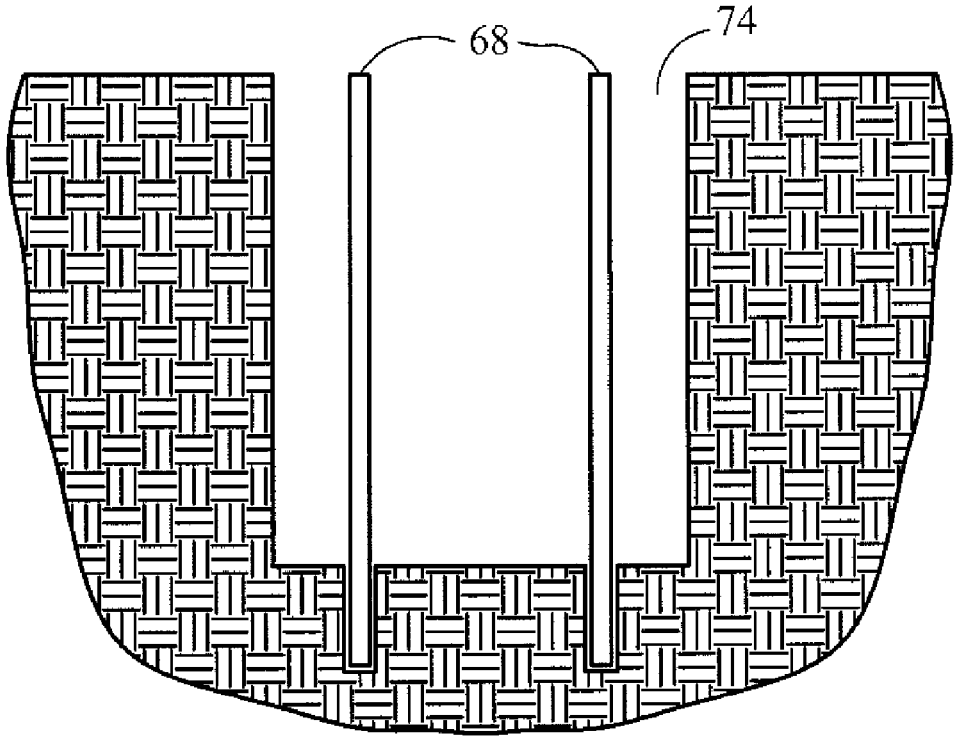
FIG. 11 is a cross sectional view of the installed grade seats in the hole.
Figure 12:
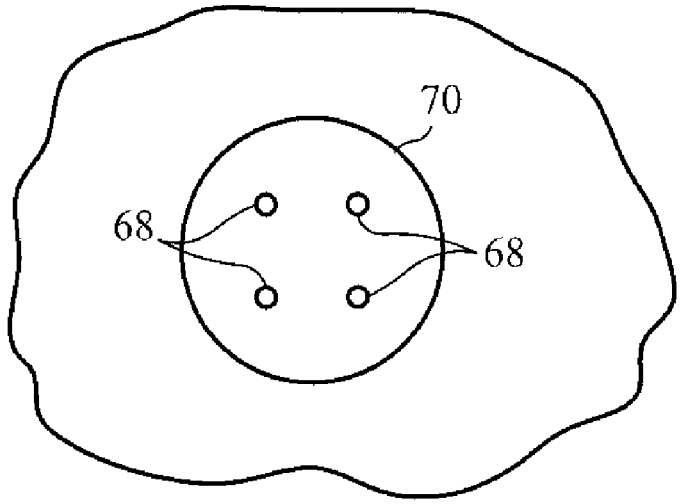
FIG. 12 is a top view of the installed grade seats in the hole.

Referring to FIGS. 11 and 12 the grade seat placement tool 60 is removed from the hole 74, leaving the grade seats 68. This process is then repeated for each of the holes 74.

Figure 13:
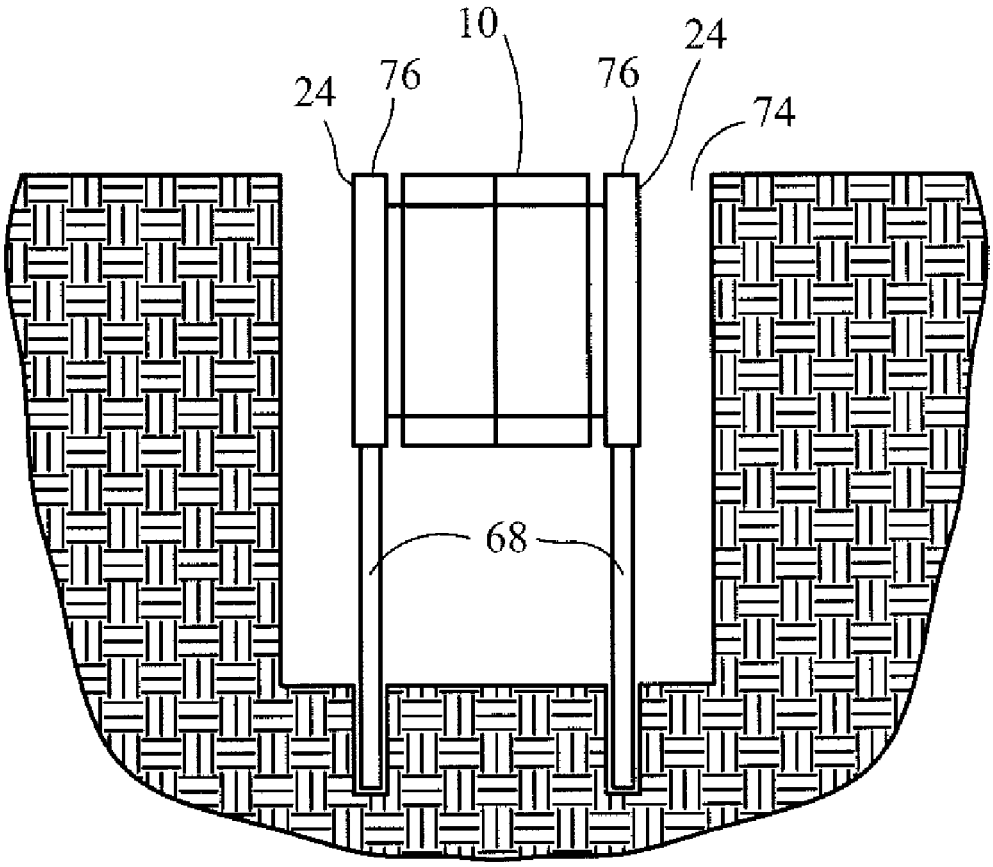
FIG. 13 is a cross sectional view of the GAMA positioned on the grade seats in the hole.
Figure 14:
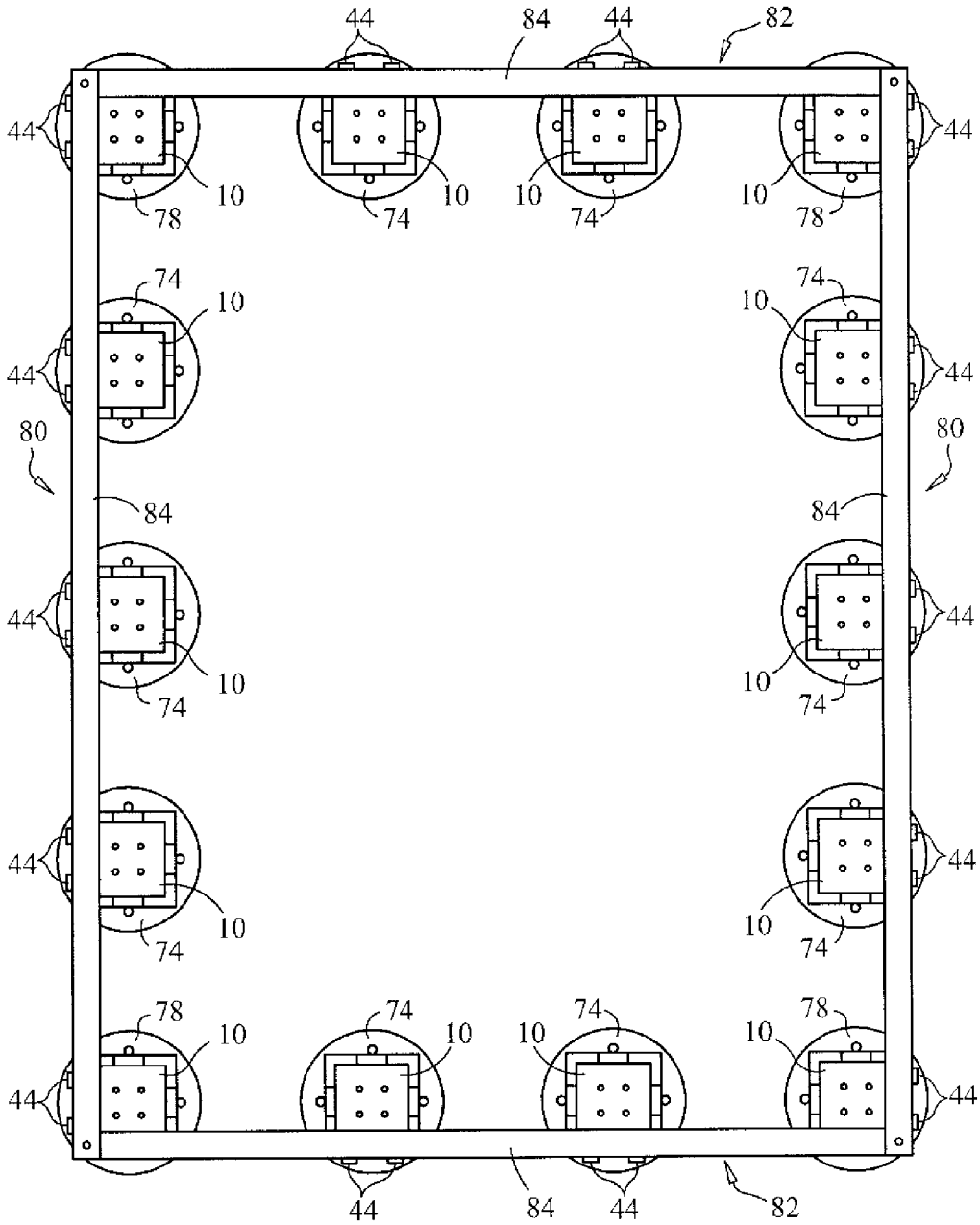
FIG. 14 is a top view of the perimeter of a building with a GAMA installed in each of the holes.

Referring to FIGS. 13 and 14, a GAMA 10 is positioned in the each of the holes 74, where the grade fixtures 24 are slide over the grade seats 68. The GAMAs 10 are seated on the grade seats 68, where the top of the grade fixtures 24 include a stop 76 which prevents the GAMAs 10 from sliding all the way down the grade seats 68. When the GAMAs 10 are positioned on the grade seats 68, the alignment channels 44 are positioned to face outwardly. For the corner holes 78, the alignment channels 44 are positioned outwardly to the side 80 rather than to the end 82 of the building perimeter.

The GAMAs 10 are now positioned at their predetermined elevations and are ready for alignment. An alignment straight edge (ASE) 84 is positioned into the alignment channel 44 in each of the GAMAs 10, where the ASEs 84 are placed in the alignment channel 44 along the sides 80 and ends 82 of the building perimeter. The ASEs 84 have predetermined lengths and spans two or more of the GAMAs 10. As the ASEs 84 are installed, the GAMAs 10 are shifted from side to side if need be to their predetermined positions and fastened to the ASE 84 to hold these positions. Upon installation of all ASEs 84 around the predetermined perimeters, the ASEs 84 are connected together forming a single structural unit. The ASEs 84 can be connected together by clamping, bolting, and the like.

In this manner, all of the GAMAs 10 are tied together allowing for further alignment of the GAMAs 10. The alignment of the GAMAs 10 can be, if required, adjusted to simultaneously level all of the GAMAs 10. For example, the GAMAs 10 can be leveled with respect to the highest hole.

The GAMAs 10 are adjusted by positioning angle supports under the ASEs 84, where required, to align the GAMAs 10.

When the GAMAs 10 are level and aligned they are ready for concrete. Concrete is poured directly through the open top of each of the GAMAs 10, filling the cavity in each of the GAMAs 10 to the top. Reinforcements, such as rebar, may then be added in the concrete while workable.

This process is repeated until all GAMAs 10 are filled. The concrete is then allowed to set a predetermined amount of time. The GAMAs 10 are removed by pulling the pins 50 and separating the first and second members 12 and 14. Unlike prior art systems that pour into a plastic of cardboard mold, the present system does not have any such single-use mold. Rather, all of the components can be re-used. After the GAMAs 10 have been removed, the holes 74,78 can be back filled.

Figure 15:
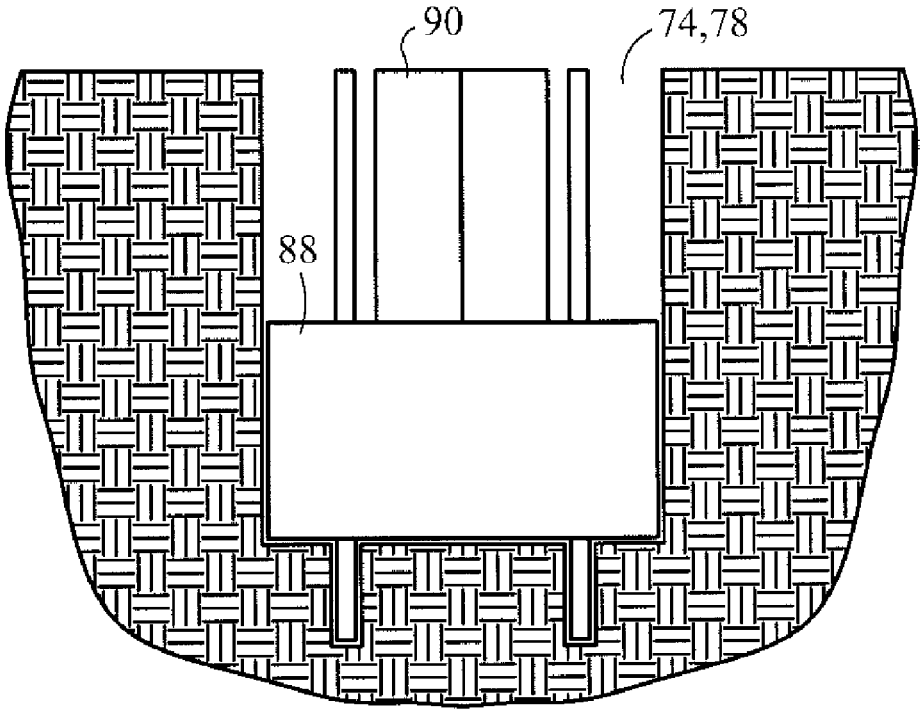
FIG. 15 is a cross sectional view of a casted footer and column base.
Figure 16:
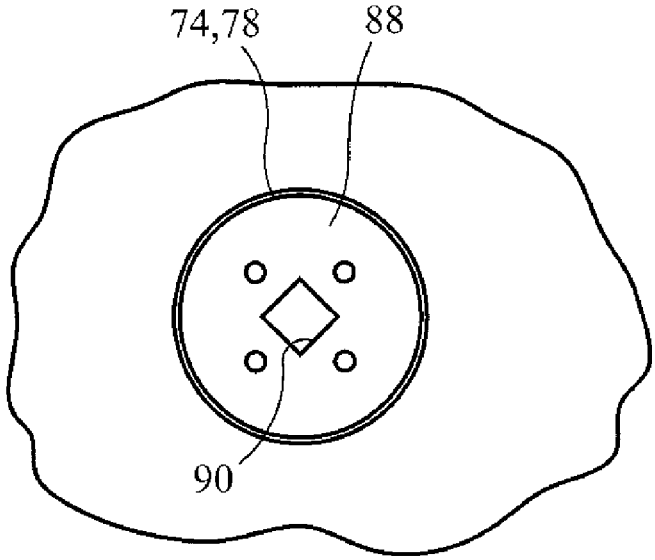
FIG. 16 is a top view of the casted footer and column base of FIG. 15.
Figure 17:
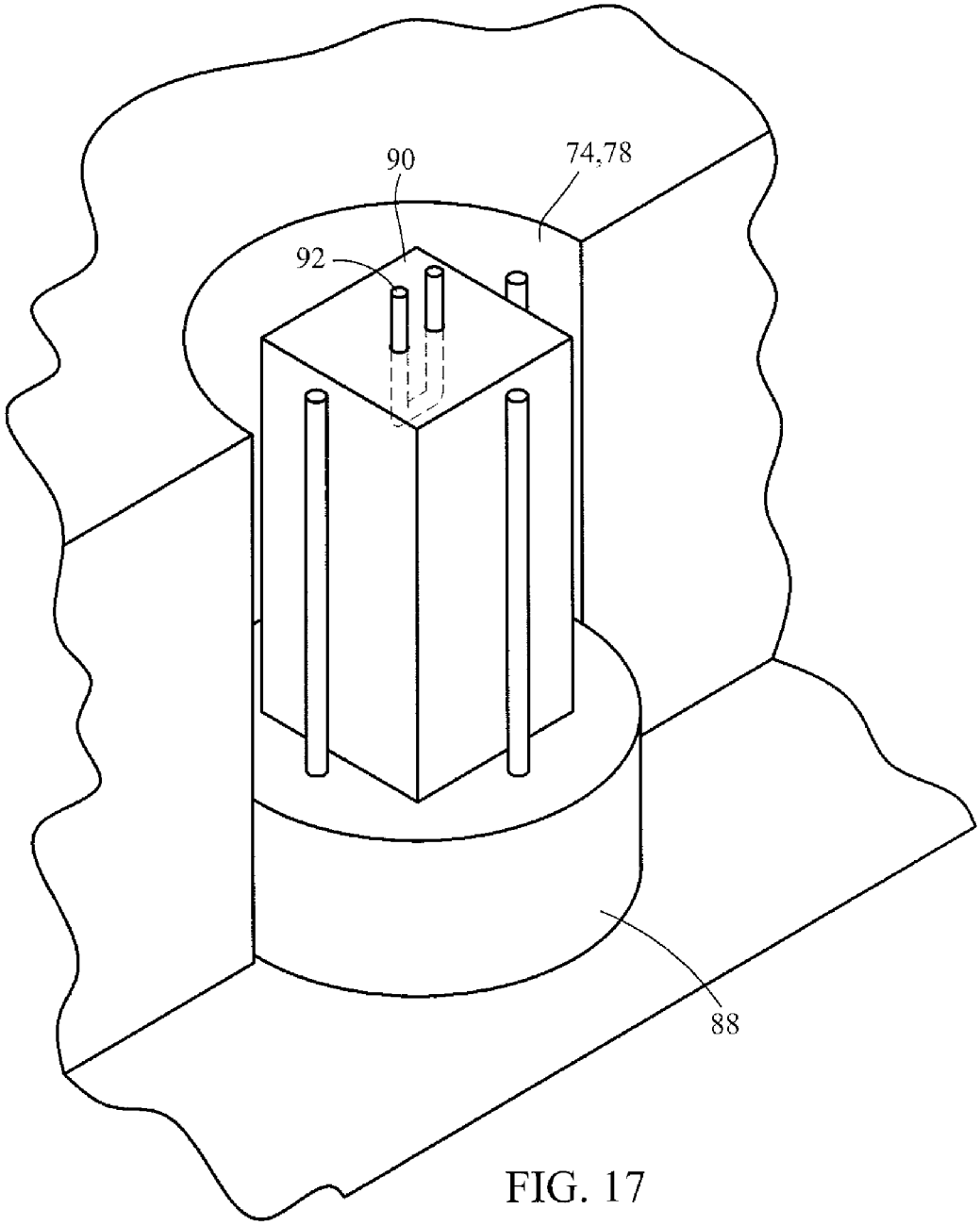
FIG. 17 is a perspective view of the casted footer and column base of FIG. 15.

Since the GAMAs 10 are set on grade seats 68, rather than the bottom of the holes, the footer and the column bases can be caste in a single pour, wherein the oversized hole is the mold for the footer and the GAMA is the mold for the upper narrower column base attaining an integral unit. Referring to FIGS. 15-17, the resulting hardened concrete forms a footer 88 with an integrated column base 90 extending there from. Additionally, as the ASEs 84 and grade seats 68 are used to set the grade or elevation of the GAMAs 10, this in turn establishes the grade or elevation of the column base 90.

As shown in FIG. 17, attachment hardware 92 can be added to the concrete when workable. The attachment hardware 92 can be used in the attachment of a post to the column base 90. In this regard, the Post-Framing System as set forth in Applicant's co-pending patent application, U.S. Patent Application Publication No. 2005/0066615, can be utilized for building construction. The contents of this published application are incorporated herein in their entirety.

In the above embodiment, the building perimeter is described as having four corners, having a rectangular shape. However, it is contemplated that the building can alternative shapes having three or more corners.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention.

What is claimed is:

1. A system for making an integrated footer and column base in a hole, the hole being made beneath where a periphery of a post frame structure is to be erected, comprising:

a grade seat placement tool having two parallel hollow alignment posts and an alignment tool, said two parallel hollow alignment posts having an inner diameter and being spaced at a fixed distance with relation to each other, and said alignment tool being configured to orient said two hollow alignment posts with the periphery of the post frame structure and being connected to and fixed in relation to said two parallel hollow alignment posts;

two grade seat posts each having a top and a diameter less than said inner diameter of a respective one of said hollow alignment posts, each of said two grade seat posts being configured to be temporarily inserted into and aligned by a respective one of said two parallel hollow alignment posts, and configured to be driven into ground beneath the hole until each of said tops of said two grade seat posts is at least level with a top of the hole; and a gradable-alignment mold apparatus (GAMA) having two hollow grade fixtures and a mold connected to said two hollow grade fixtures, said two hollow grade fixtures being parallel to each other and spaced at the fixed distance that said two parallel hollow alignment posts of said grade seat placement are spaced, each of said two hollow grade fixtures having an open ended bottom for receiving a respective one of said two grade seat posts, said mold having a cross section less than the hole.

2. A method for making integrated footer and column bases for a post frame building using the system of claim 1, comprising:

a. mapping the periphery of the post frame building on a building site;

b. determining corners of the post frame building on the building site;

c. determining elevation of the building site;

d. digging a plurality of holes about the periphery;

e. positioning the grade-seat placement tool in one of the holes;

f. aligning the alignment tool of the grade-seat placement tool with the perimeter;

g. positioning the grade seats in the plurality of hollow alignment posts, one grade seat per each post;

h. removing the grade-seat placement tool from the hole, wherein the grade seats remain in the hole;

i. positioning the gradable-alignment mold apparatus on the grade seats by sliding the hollow grade fixtures over the grade seats;

j. repeating e) through i) for each of the holes;

k. interconnecting each of the gradable-alignment mold apparatus in each of the holes together, wherein the interconnected gradable-alignment mold apparatus moves as a single unit;

l. leveling the interconnected gradable-alignment mold apparatus as a single unit;

m. pouring cement into the mold until the cement in the mold is level with a top of the gradable-alignment mold apparatus;

m.1 pouring cement in the hole beneath the mold, the cement beneath the mold being as wide as the hole;

n. letting the cement set; and o. removing the gradable-alignment mold apparatus from the set cement by separating the first and second members.

3. The system according to claim 1, wherein:

said gradeable-alignment mold apparatus (GAMA) includes a first member and a second member, the first and second members being detachably connected together defining a tubular passage therethrough, a first of said two hollow grade fixtures is affixed to the first member; and a second of said two hollow grade fixtures is affixed to the second member.

4. The system according to claim 1, wherein the grade-seat placement tool comprises:

an upper plate;

a lower plate; and said two hollow alignment posts being positioned between the upper plate and the lower plate, wherein a top end of each alignment post extends as high as the upper plate and a bottom end of each alignment post extends as low as the lower plate.

5. The system according to claim 4, wherein the grade seats are positionable through the hollow alignment posts.

6. The system according to claim 4, wherein said alignment tool is disposed on said upper plate.

7. The system according to claim 1, wherein said two hollow grade fixtures are disposed around and about an exterior surface of a wall of said mold.

8. The system according to claim 1, wherein the grade-seat placement tool includes four hollow alignment posts and the gradable-alignment mold apparatus includes four hollow grade fixtures.

9. The system according to claim 3, wherein the first and second members are pinned together.

10. The system according to claim 3, wherein the tubular passage has a square cross sectional area.

11. The system according to claim 1, further comprising a further GAMA, said further GAMA being connected to said gradable-alignment mold apparatus forming a single structural unit.

12. The system according to claim 3, wherein the gradable-alignment mold apparatus is removable from set cement in the mold by separating the first and second members.

13. The system according to claim 1, further comprising a stop formed on one of said two hollow grade fixtures for limiting how far one of said two grade seat posts can be inserted within said one of said two hollow grade fixtures.

14. The system according to claim 1, wherein a top of said mold has an opening formed therein.

15. The system according to claim 1, wherein a bottom of said mold has an opening formed therein.

16. The system according to claim 1, further comprising cement in said mold for forming a column.

17. The system according to claim 16, further comprising further cement connected to said cement and extending beneath said cement and extending wider than said cement in order to form a footer beneath said column.

18. The system according to claim 1, wherein said two grade seat posts each is taller than the hole.

* * * * *